United States Patent [19]

Lee et al.

[11] 4,258,358

[45] Mar. 24, 1981

[54] DOOR OPENING SENSING AND ALARM PRODUCING DEVICE

[75] Inventors: Thomas K. P. Lee; Hau C. Lam, both of Kowloon, Hong Kong

[73] Assignee: International Quartz Ltd., Kowloon, Hong Kong

[21] Appl. No.: 66,498

[22] Filed: Aug. 14, 1979

[30] Foreign Application Priority Data

Aug. 16, 1978 [GB] United Kingdom ..... 33543/78

[51] Int. Cl.[3] ..... G08B 13/08

[52] U.S. Cl. ..... 340/543; 340/384 E; 340/547; 361/171

[58] Field of Search ..... 340/547, 545, 543, 541, 340/384 E; 361/171

[56] References Cited

U.S. PATENT DOCUMENTS

| | | | |
|---|---|---|---|
| 3,380,024 | 4/1968 | Watkinson | 361/171 |
| 3,594,786 | 7/1971 | Brunner-Scawer et al. | 340/384 E |
| 3,659,154 | 4/1972 | Finn | 340/543 |
| 3,846,782 | 11/1974 | Brodsky . | |
| 3,866,201 | 2/1975 | Beiswenger . | |
| 3,938,120 | 2/1976 | O'Connell . | |
| 3,986,183 | 10/1976 | Fujiwara . | |
| 4,021,796 | 5/1977 | Fawcett, Jr. et al. . | |
| 4,057,773 | 11/1977 | Cohen . | |
| 4,059,832 | 11/1977 | Conklin . | |
| 4,064,507 | 12/1977 | Schmitz | 340/541 |
| 4,095,239 | 6/1978 | Gerry | 340/543 |
| 4,114,147 | 9/1978 | Hile | 340/528 |
| 4,122,437 | 10/1978 | Petersen | 340/384 E |
| 4,151,520 | 4/1979 | Full | 340/528 |

*Primary Examiner*—Glen R. Swann, III
*Attorney, Agent, or Firm*—Thomas R. Vigil

[57] ABSTRACT

The device includes a housing, a keyboard on the housing, and a loudspeaker and electric components within the housing. The housing is mounted on a door adjacent a magnet mounted on the door frame. The device includes an audio alarm circuit including a loudspeaker for generating an audio alarm, a control circuit coupled to the alarm circuit for controlling operation of the alarm circuit, and signal generating curcuitry including door motion sensing logic for sensing when the door has been opened and for generating an alarm signal which is applied to the control circuit for operating the alarm circuit. The device further includes a programmable alarm inhibiting circuit including the keyboard which comprises a plurality of keys and pushbutton switches operated by the keys. The alarm inhibiting circuit includes keyboard decoding logic. A code setting circuit includes three leads which are coupled to the keyboard decoding logic and which are releasably connected to one side of the pushbutton switches. The switches are actuated by the keys to present a number to the keyboard decoding logic which compares that number with a stored number defined by the switches to which the leads are connected. When the number presented to the keyboard decoding logic is presented in a proper timed sequence and corresponds with the stored number, an alarm inhibit signal is produced by the keyboard decoding logic which signal is supplied to the control circuit for stopping the control circuit from operating the audio alarm circuit.

58 Claims, 5 Drawing Figures

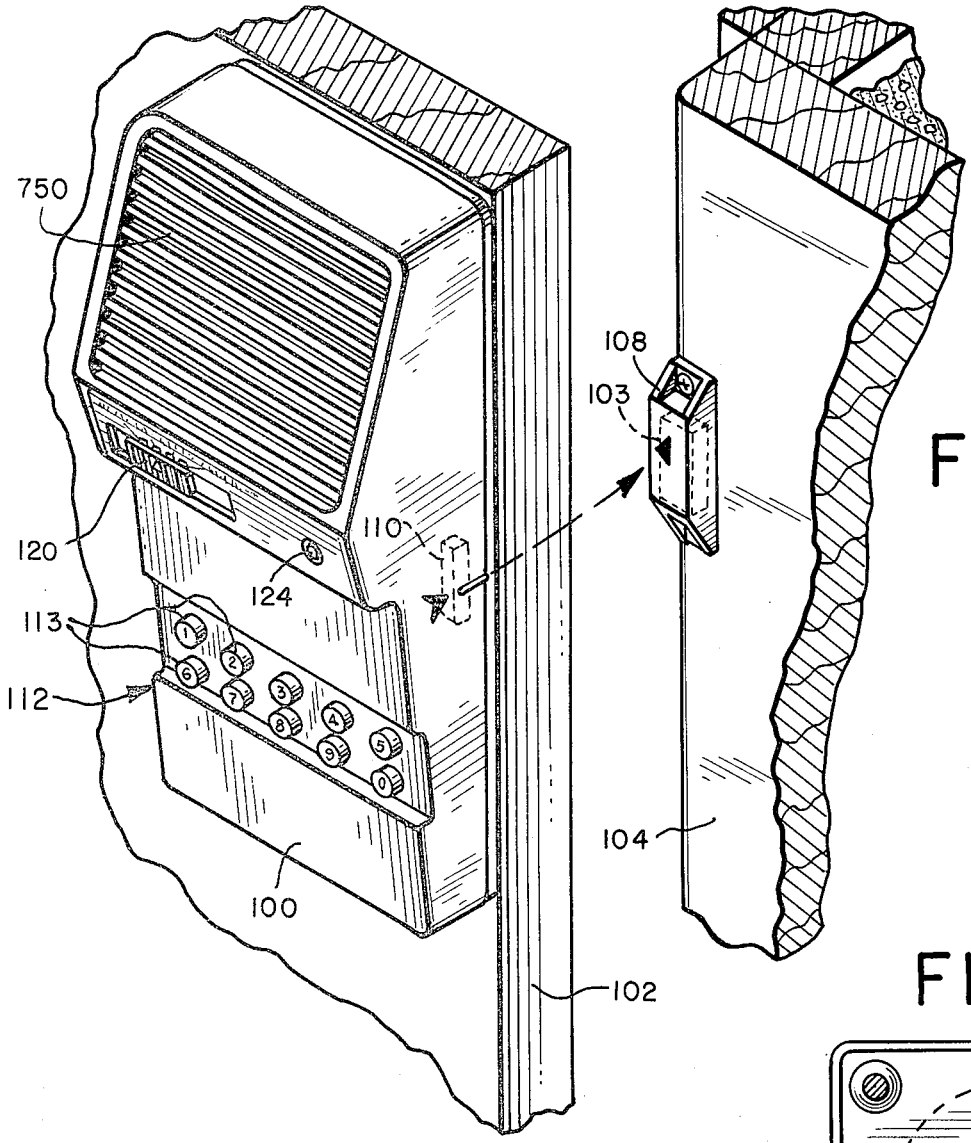
FIG. 1
FIG. 2
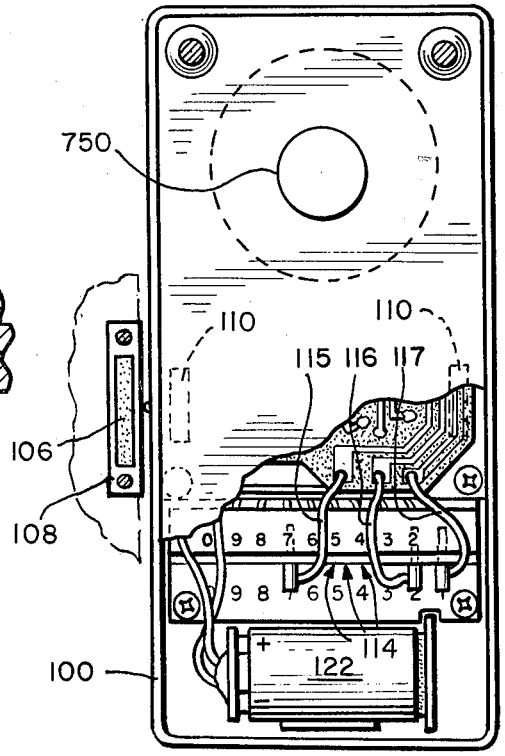
FIG. 3
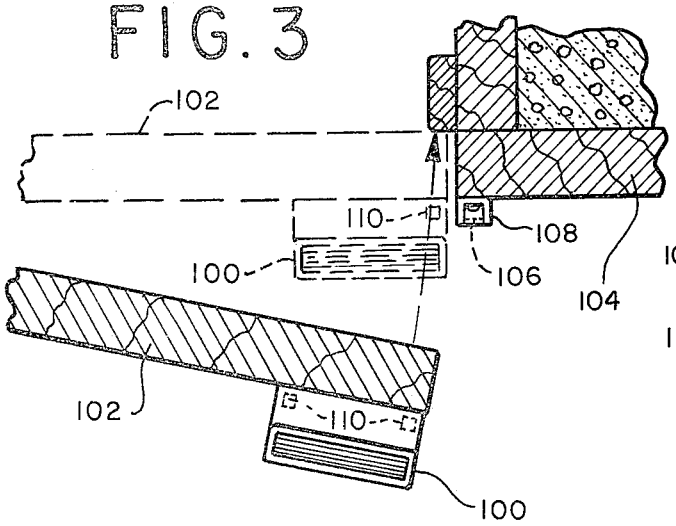

DOOR OPENING SENSING AND ALARM PRODUCING DEVICE

BACKGROUND OF THE INVENTION

1. Field of the Invention

The present invention relates to door opening sensing and alarm producing devices which provide an audio alarm when the opening of a door is sensed.

2. Description of the Prior Art

Heretofore various types of devices have been proposed for detecting the presence of an intruder or more specifically the act of entry by an intruder into a protected area such as by the opening of a door.

Many of these devices have consisted in means for sensing when a door has been opened by an unauthorized person. Examples of such previously proposed intruder detection alarm devices and related devices are disclosed in the following patents.

| U.S. PAT. NO. | PATENTEE |
|---|---|
| 3,846,782 | Brodsky |
| 3,866,201 | Beiswenger |
| 3,938,120 | O'Connell |
| 3,986,183 | Fujiwara |
| 4,057,773 | Cohen |
| 4,059,832 | Conklin |

The use of movement of a magnet in a door alarm system is disclosed in the Fujiwara U.S. Pat. No. 3,986,183 and the Cohen U.S. Pat. No. 4,057,773 referred to above.

Also it is known from the O'Connell U.S. Pat. No. 3,938,120 to provide a mechanism which will produce a desired sound, namely a voice message, when a door is opened.

Also, a security alarm device for providing a variable pitch siren sound utilizing a free-running multivibrator and a relaxation type saw tooth oscillator is disclosed in the Beiswenger U.S. Pat. No. 3,866,201.

Still further, there is disclosed in the Brodsky U.S. Pat. No. 3,846,782 an intruder detection system for protecting an area with a keyboard inhibitor for reentry which is utilized for controlling a detection and surveillance system having an alarm. In this patent, there is disclosed an alarm system with multiple modes and a reset keyboard. However the reset keyboard is mounted for actuation from outside the area being protected. Also the detection system disclosed in this patent utilizes silicon controlled rectifiers and three transistors which prevent one from depressing three switches simultaneously. This circuit arrangement is not unlike a train signal "interlock" that allows only one of three levers to be moved at a time. Also in addition to connecting the three switches, the remaining switches utilized must be strapped to a reset transistor.

As will be described in greater detail hereinafter, the device of the present invention differs from the previously proposed intruder alarm detection devices and systems by providing a simple system utilizing a relatively simple circuit which requires that the keys must be struck in a proper timed (slow) sequence and must correspond to a predetermined number stored in the circuit to stop or inhibit operation of an audio alarm.

More specifically, the storing of the number is achieved by three programming leads and by providing circuit connections such that striking the wrong key still clears the memory without connecting other leads.

Moreover, the intruder alarm device of the present invention differs from the previously proposed devices by providing reed switches or relays and by providing an alarm circuit, a doorbell circuit and a visitor announcing circuit in the same device.

SUMMARY OF THE INVENTION

According to the invention there is provided a door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means.

Further according to the invention there is provided a door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means and programmable alarm inhibiting circuit means coupled to said control circuit means for supplying, upon proper actuation of said alarm inhibiting circuit means, an alarm inhibit signal to said control circuit means to inhibit or stop said control circuit means from operating said alarm circuit means, said control circuit means including a latching circuit having an output coupled to said audio alarm circuit means and a mechanical switch having one side thereof coupled to an input to said latching circuit and having the other side thereof directly or indirectly coupled to said signal generating means, said mechanical switch having an instant alarm position for directly coupling said signal generating means to said latching circuit and a delay alarm position for coupling said signal generating means through a time delay circuit to said latching circuit.

Still further according to the invention there is provided a door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto being coupled to said control circuit means for supplying an alarm signal thereto for causing said control circuit means to operate said alarm circuit means and programmable alarm inhibiting circuit means coupled to said control circuit means for supplying, upon proper actuation of said alarm inhibiting circuit means, an alarm inhibit signal to said control circuit means, an alarm inhibit signal to said control circuit means to inhibit or stop said control circuit means from operating said alarm circuit means, said signal generating means including a time delay circuit, said device further including visitor announce sound producing means and said control circuit means including mechanical switch means for connecting said signal generating means (a) directly to said control circuit means, (b) through said time delay circuit to said control circuit means, or (c) to said visitor announce sound producing means.

BRIEF DESCRIPTION OF THE DRAWINGS

FIG. 1 is a perspective fragmentary view of a door and door frame assembly showing the door in a partially open position and showing the door opening sensing and alarm producing device of the present invention.

FIG. 2 is a vertical back view with portions broken away of the door opening sensing and alarm producing device of the present invention as shown in FIG. 1.

FIG. 3 is a top plan view of the door assembly and the door opening sensing and alarm producing device shown in FIG. 1.

DESCRIPTION OF THE PREFERRED EMBODIMENT

Figure 4A:
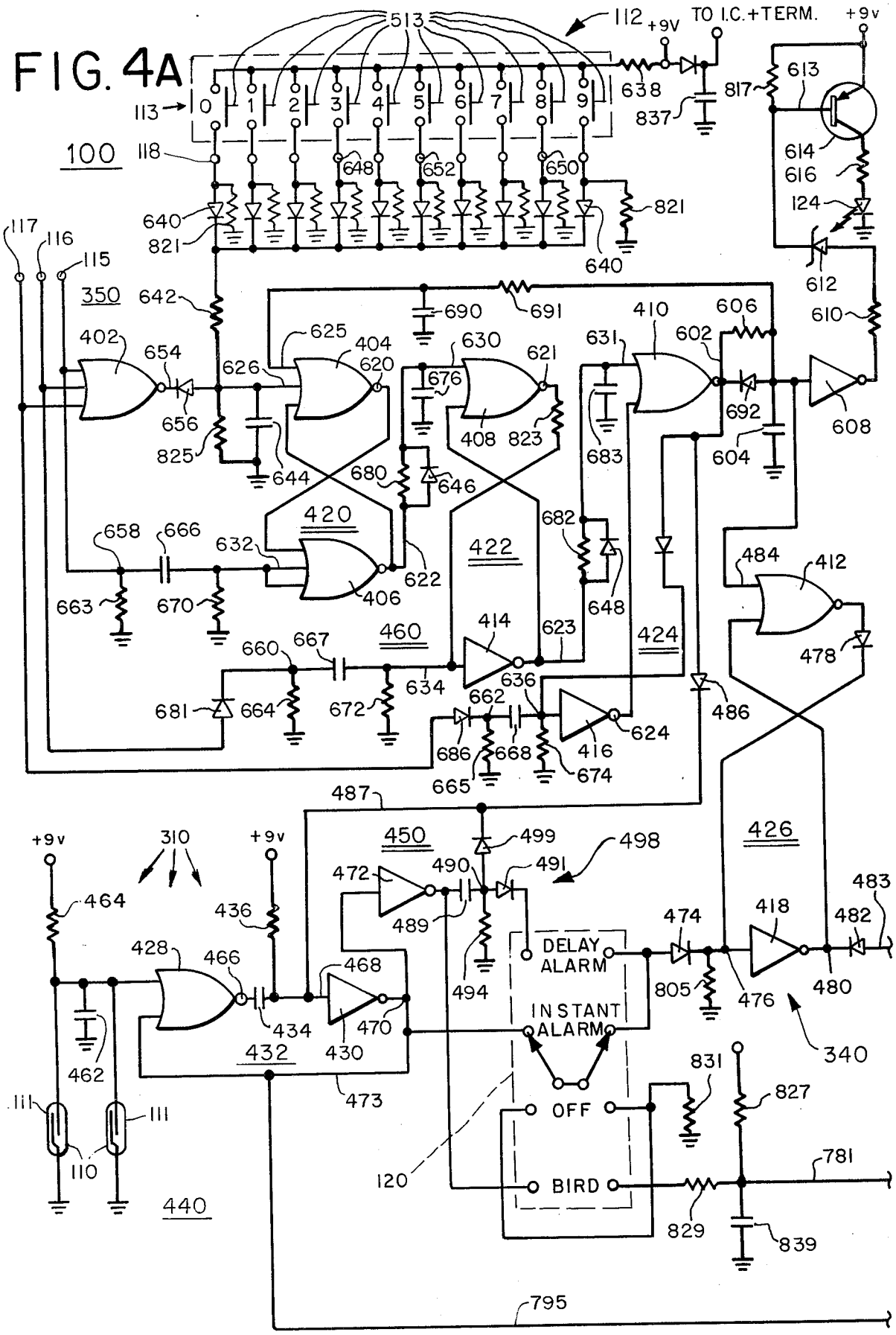
FIGS. 4A and 4B are a schematic circuit diagram of the electrical circuitry of the door opening sensing and alarm producing device of the present invention.

Referring now to the drawings in greater detail there is illustrated in FIG. 1 a door opening sensing and alarm producing device 100 constructed according to the teachings of the present invention. As shown, the device 100 includes a housing 101 which is affixed to a door 102. Mounted upon a frame 104 for the door 102 is a magnet 106 which is fixed within a mounting block 108 that is attached to the door frame 104 at the same height of the device 100.

With reference to FIGS. 1, 2 and 3, when the door 102 is closed, the positioning of the device 100 and the magnet 106 is such that the magnet 106 is adjacent a reed switch 110 mounted within the housing 101 of the device 100 and causes the contacts 111 (FIG. 4A) of the switch 110 to close. When the door 100 is opened, the motion moves the magnet 106 away from the switch 110, thereby allowing the contacts 111 of the switch 110 to open. The switch 110 is a conventional magnetically actuated, glass-encapsulated reed switch. In a preferred embodiment of the alarm device 100, two switches 110 are provided (See FIGS. 3 and 4A) on either side of the housing 101 of the device 100 so that the device 100 may be mounted on doors hinged on either the left or right side. Also the location of the device 100 and magnet 106 can be reversed with the magnet 106 mounted on the door 102 and the device 100 mounted on the frame 104. As will be described in greater detail hereinafter, once the device is set to announce the opening of the door 102, i.e., the presence of an intruder, the opening of the switch 110 will set in motion an audio alarm function of the device 100 which immediately, or after a short time delay, will sound an audio alarm and which, upon proper actuation of the device 100, can defeat or inhibit the audio alarm function.

With reference to FIGS. 1, 2 and 4A, the device 100 includes a keyboard 112 (FIG. 1) including ten numbered keys 113 (FIGS. 1 and 4A) corresponding to the digits 0 to 9. These keys when actuated at the proper speed and in the proper sequence, cause the audio alarm function of the alarm device 100 to be defeated. The particular combination and sequence of digits that must be depressed to defeat the alarm function is determined by plugging three leads 115, 116 and 117 respectively into sockets 118 (FIG. 4A) corresponding to the desired three digits. This combination and sequence may be changed at any time.

The device 100 is placed into operation by a four position switch 120 (FIGS. 1 and 4A). In addition to an "OFF" position, the switch 120 provides a "BIRD", position such that a pleasant, soft chirping sound is produced whenever the door is opened. The switch 120 also provides two alarm positions, an "INSTANT ALARM" position that sounds an alarm whenever the door 102 is opened without the proper combination of digits having been depressed, and a "DELAY ALARM" position that provides a delay interval after the door 102 is opened and before an alarm is sounded, thereby permitting the device 100 to be mounted inside the door and the keyboard to be actuated after the door is opened.

As shown, the device 100 is powered by a battery 122 (FIG. 2) which is a conventional 9 volt battery. Alternatively, it may be powered by any suitable 9 volt source, such as a 110 volt step down transformer and rectifier or capacitor and rectifier of the type used to power portable calculators from a 110 volt line.

When the proper code to disable the alarm mechanism is keyed on the keyboard 112, a light emitter diode 124 (FIGS. 1 and 4A) is illuminated to inform the party keying the code that the alarm function has been defeated (disabled).

Figure 4B:
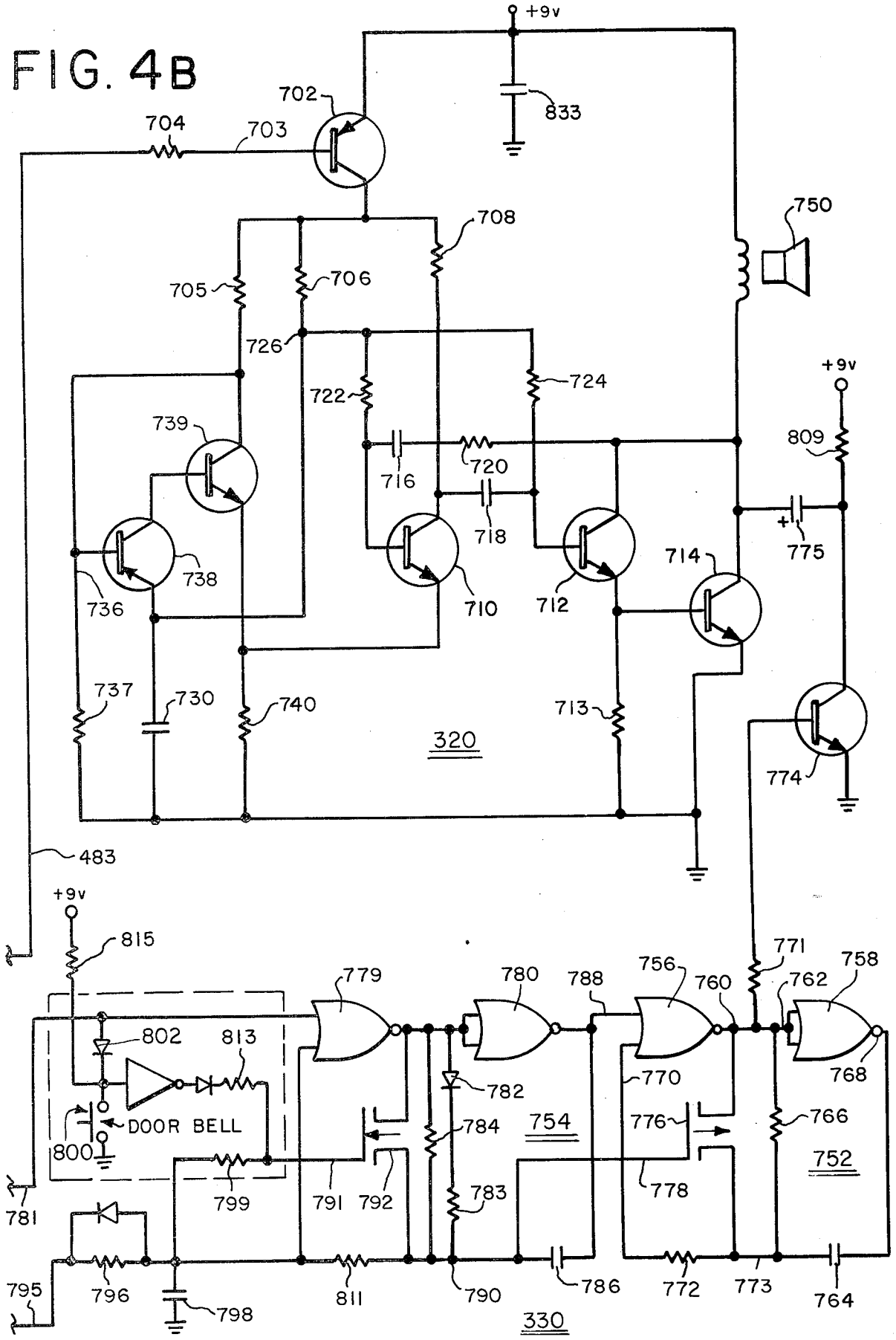

Referring now to FIGS. 4A and 4B there is disclosed therein a complete circuit 300 and logic diagram of the electronic circuit 300 including components of the intruder alarm device 100. The circuit 300 includes a signal generating circuit 310 including the switch(es) 110, an audio alarm circuit 320 for generating an audio alarm, a "bird chirp" circuit 330 for generating a bird chirping sound, control circuitry 340 including switch 120 for coupling the signal generating circuit to either the audio alarm circuit 320 or to the bird chirp circuit 330, and a programmable alarm inhibiting circuit 350 including the keyboard 112, the sockets 118 and the leads 115, 116 and 117.

As shown, the circuit 300 includes a plurality of integrated circuit NOR gates such as gates 402, 404, 406, 408, 410 and 412 and a plurality of NOT gates such as gates 414, 416, and 418 which are all constructed using conventional complimentary symmetry, metal oxide semiconductor ("COSMOS") integrated circuits. The 9 volt supply lead and ground power supply lead for these integrated circuit elements are omitted for clarity. Briefly described, the output of a NOT or NAND gate goes to ground when any input lead to the gate goes positive. A bistable multivibrator referred to as a flip flop or memory device is formed by cross-connecting the inputs and outputs of a pair of gates and the NOR gates 404, 406, 408 and 410 form multivibrator circuits in the alarm inhibiting circuit 350. For example, a flip flop 420 is formed from the cross-connected gates 404 and 406, a flip flop 422 is formed from the cross-connected gates 408 and 414, a flip flop 424 is formed from the cross-connected gates 410 and 416 in the alarm inhibiting circuit 350 and an alarm control flip flop 426 is formed from the cross-connected gates 412 and 418 in the control circuitry 340. A NOR gate 428 and a NOT gate 430 are also cross-connected in the signal generating circuit 310, but the connection from the gate 428 to the gate 430 incudes a series capacitor 434 between the gates and a resistor 436 connected to +9 volts. Accordingly, the gates 428 and 430 are interconnected to form a monostable multivibrator 432 in the signal generating circuit 310. While it appears unusual to form flip flops and multivibrators with NOT gates, since such gates normally have only one input, the circuit arrangement is such that at least two and sometimes three signals are fed into each of the NOT gates 414, 416, 418 and 430 through diodes. So, these NOT gates and their respective input leads and diodes are actually functioning as multiple input NAND gates.

Briefly, the signal generating circuit 310 includes a door motion detection logic 440 and a delay timing logic 450 which are shown in the lower portion of FIG. 4A. The alarm inhibiting circuit 350 includes not only keyboard 112 but also keyboard decoding logic 460 comprising the flip flops 420, 422 and 424 which are shown in the upper portion of FIG. 4A. The control circuitry 340 not only includes switch 120 but also the alarm control flip flop 426 at the right edge of FIG. 4A. The audio alarm circuitry 320 is shown in the upper half of FIG. 4B and the "bird chirp" circuit 330 is shown in the lower half of FIG. 4B.

Referring now to FIG. 4A, when the switch 120 is in the "OFF" position, it completely disconnects the door motion detection logic 440 from the alarm control flip flop 426 leading to the audio alarm circuit 320 and from the bird chirp circuit 330 and thereby disables both audio alarm and bird chirp functions.

When the switch 120 is in the "BIRD" position, it connects the inverted output of the monostable multivibrator 432 to the bird chirp circuit 330. Whenever the door 102 is opened, the contacts 111 of the reed switch 110 open and allow a capacitor 462 to be charged by a current flowing through a resistor 464. The positive voltage thus developed across the capacitor 462 triggers the monostable multivibrator 432 and causes an output 466 of the gate 428 to go low. Since the series capacitor 434 cannot suddenly discharge, it pulls an input 468 of the gate 430 low and causes an output 470 of the gate 430 to go high. This high level signal is inverted by a gate 472 and flows through the switch 120 to the bird chirp circuit 330 which responds by causing a chirping sound to be produced by a loudspeaker (750 in FIGS. 4B and 1.)

Ultimately, the capacitor 434 charges through the resistor 436 until the output of the gate 430 again goes negative and deactivates the bird chirp circuit 330. The time constant formed by the resistor 436 and the capacitor 434 is chosen to give a delay time of roughly seven seconds, although this delay time may be varied, so the chirping endures for roughly seven seconds. The bird chirp circuit 330 remains deactivated until the door 102 is again closed so that the contacts 111 close and discharge the capacitor 462 and cause the output 466 of the gate 428 to return a positive level so that the capacitor 434 may again discharge itself. A premature closing of the door will not terminate the bird chirping however, since the positive level at the output 470 from the gate 430 flows back into the gate 428 via conductor 473 and locks the gate 428 with its output 466 at ground potential until the capacitor 434 has charged.

When the switch 120 is in the "INSTANT ALARM" position, it connects the output 470 of the monostable multivibrator 432 through a diode 474 to an input 476 of the alarm control flip flop 426, an output 480 from which controls operation of the audio alarm circuit 320. The flip flop 426 is normally in a state where it generates a high level signal at the output 480 of gate 418 which cannot flow through a reverse biased diode 482 on conductor 483 so that no current reaches the base of a transistor 702 (in FIG. 4B) within the audio alarm circuit 320 and the alarm circuit 320 is therefore disabled. But when the door 102 is opened, the contacts 111 close and trigger the multivibrator 432, causing the multivibrator output 470 to go positive for about seven seconds and set the alarm control flip flop 426 such that the output 480 goes to ground potential and renders the transistor 702 (in FIG. 4B) fully conductive. The audio alarm circuit 320 then generates a loud audio alarm signal which persists until a proper code is keyed on the keyboard 112 to cause the keyboard decoding logic 460 to supply a positive level "reset" signal to an input 484 of the alarm control flip flop 426. Even moving the switch 120 to the "OFF" position will not terminate the alarm once the flip flop 426 is reset.

If the proper code is keyed in the keyboard 112 before the door 102 is opened, a high level signal from the keyboard decoding logic 460 flows through a diode 486 via conductor 487 to the input 468 of gate 430 and prevents the input 468 from going negative. The output 470 is thus locked at ground potential, and no alarm can occur.

When the switch 120 is in the "DELAY ALARM" position, the input 476 of the alarm control flip flop 426 is connected to the monostable multivibrator 432 output 470 through the NOT gate 472, a capacitor 489, a node or junction 490, a diode 491 and the switch 120 and the diode 474. The node 490 common to the capacitor 489 and diode 491 is also connected to ground by a resistor 494. When the door 102 opens, the positive going seven second square waveform that flows from the multivibrator output 470 is inverted by the gate 472 and is applied to the capacitor 489 and resistor 494 which together form a differentiator or pulse former 498. This pulse former 498 converts the leading edge of the negative going seven second square waveform that flows from the gate 472 into a negative going pulse and also converts the positive going trailing edge of the square waveform into a positive going pulse that occurs seven seconds later. The diode 491 and a diode 499 block the negative pulse. The delayed positive pulse flows directly to the input 476 of the alarm control flip flop 426 and normally sets the flip flop 426, thereby initiating an alarm. But if the proper code has been previously keyed in on the keyboard 112, a high level signal from the keyboard decoding logic 460 flows continuously to the alternate input 484 of the alarm control flip flop 426 and prevents the setting of the flip flop 426. In that case, the positive pulse generated by the pulse former 498 flows through the gate 418 to the alarm circuit 320 but this pulse lasts only a fraction of a second and is too brief to trigger an alarm.

The diode 499, by providing positive feedback to the input 468 of the gate 430 feeds a small amount of current into the capacitor 434 to assist the charging of same and thereby speeds the switching of the gate 430 in response to the slow charging of the capacitor 434 in the manner of a Schmitt trigger circuit.

The keyboard decoding logic 460 functions together with key switch contacts 513 of the keyboard 112 to generate a high level signal at an output of logic 460 when the proper numeric code has been keyed in at the proper speed. This signal flows through the diode 486 and blocks the multivibrator 432, as has been explained above, and it also charges a capacitor 604 through a resistor 606 (in about 0.1 second) and thereby clears the alarm control flip flop 426 and prevents that flip flop from being set as has also been explained above. This same signal flows through a gate 608, a resistor 610 and a Zener diode 612 to base 613 of a transistor 614 and renders the transistor 614 conductive. Current from the transistor 614 then flows through a resistor 616 to the light emitting diode 124 (FIGS. 1 and 4A) to signal when the proper code has been keyed in.

The keyboard decoding logic 460 comprises the three flip flops 420, 422 and 424, all of which are normally "cleared" with outputs 620, 621 and 602 of the uppermost gates 404, 408 and 410 of each flip flop at ground potential and outputs 622, 623 and 624 of the lowermost gates 406, 414 and 416 of each flip flop at a positive potential. Each of these flip flops 420, 422 and 424 includes one or more "clear" signal inputs 625, 626, 630 and 631 to which a positive signal is applied whenever it is desired to "clear" the corresponding flip flop, and each also includes a "set" input 632, 634, and 636 to which a positive signal is applied whenever it is desired to "set" the corresponding flip flop. The first flop flop 420 may be cleared by actuation of any of the keys 513 that is not connected to one of the three leads 115, 116 and 117. For example, if the left-most of the switch contacts 113 is acutated, a current flows from the 9 volt battery through a resistor 638 and the actuated switch contacts 113, through a diode 640, and through a resistor 642, into a capacitor 644. The time constant of the capacitor 644 and the resistors through which this current flows is such that the capacitor 644 is charged after only about 100 microseconds to such a level that the "clear" input 626 of the flip flop 420 is driven positive. The flip flop 420 is thus cleared whenever any of the key switch contacts 513 is actuated (unless the capacitor 644 is prevented from charging by the gate 402 as will be explained).

When the flip flop 420 is cleared, it generates a high level signal at its output 622 that flows through a diode 646 to the "clear" input 630 of the flip flop 422 and clears the flip flop 422. In a like manner, a high level signal from the output 623 of the flip flop 422 flows through a diode 648 to the "clear" input 631 of the flip flop 424 and clears the flip flop 424. Accordingly, random actuation of the key switch contacts 513 quickly clears all of the flip flops 420, 422 and 424.

As explained above, the three leads 115, 116 and 117 are adapted to be plugged into sockets 118 (FIGS. 2 and 4A) corresponding to the three digits of a chosen alarm defeating/alarm inhibiting code. Assume, for example, that the code is "3", "8" and "5", the lead 115 is plugged into a socket 648 associated with key "3" of the key switch contacts 513, the lead 116 into a socket 650 associated with key "8" of the key switch contacts 513, and the lead 117 into a socket 652 associated with key "5" of the key switch contacts 513. Now, actuation of any of the three keys "3", "8" or "5" no longer clears the flip flop 420 and the remaining flip flops. In this respect, before the capacitor 644 can charge and supply a positive signal to the "clear" input 626, current flows from the actuated switch through the corresponding socket 648, 650 or 652 and over the corresponding lead 115, 116, or 117 to gate 402. An output 654 of the gate 402 goes negative and, acting through a diode 656, clamps the "clear" input 626 at ground potential and prevents the flip flops from being cleared.

Actuation of any one of these three switches also causes a positive potential to flow over the corresponding leads 115, 116 or 117 to one of three nodes 658, 660 or 662 each of which is connected to ground by a resistor 663, 664 or 665. The nodes 658, 660 and 662 are connected to the respective "set" inputs 632, 634 and 636 of the three flip flops 420, 422 and 424 by series capacitors 666, 667 and 668 respectively, which together with respective associated resistors 670, 672 and 674 form pulse formers that respond to switch actuation by supplying positive pulses to the "set" inputs 632,634 and 636 of the flip flops 420, 422, and 424. These pulses would normally "set" the corresponding flip flops, but if a preceeding flip flop is not set, it "locks" the next flip flop in the "clear" state and prevents these pulses from having any effect. Accordingly, when all three flip flops are cleared, the flip flop 420 locks the flip flop 422 in its "clear" state, and the flip flop 422 locks the flip flop 424 in the "clear" state. Accordingly, only the flip flop 420 is in a state where it may be "set" by actuation of the appropriate key of the key switch contacts 513. Actuation of the remaining keys either clears all of the flip flops or has no effect, as has been explained.

Let it be assumed that the device is programmed (leads 115, 116 and 117 are connected) so that actuation of the keys "3", "8" and "5" in sequence defeats the alarm. Let it be further assumed that all three flip flops 420, 422 and 424 are cleared initially. Actuation of the "3" key then causes current to flow from the socket 648 over the lead 115 to the node 658 from whence a positive pulse flows to the input 632, setting the flip flop 420 and causing a ground level signal to appear at the output 622. For roughly one third of a second a high level signal remains present at the "clear" input 630 of the flip flop 422 due to the charge stored in a capacitor 676, but this signal is bled off to ground through a resistor 680 so that after about one third of a second the flip flop 422 is unlocked so that it can be set by actuation of the "8" key. Note if the keys are actuated too rapidly, the flip flop 422 remains locked and is not set when the "8" key is actuated. Accordingly, one cannot rapidly enter all possible numeric combinations and thereby determine the proper combination to use. The keys must be actuated slowly as well as in the proper sequence.

After actuation of the "3" key has set the flip flop 420, actuation of the "8" key causes current to flow from the socket 650 over the lead 116 and through a diode 681 to the node 660. A positive pulse then flows to the "set" input 634 of the flip flop 422 and the output 623 of this flip flop goes to ground potential. After about one third of a second, current flow through a resistor 682 discharges a capacitor 683 and releases the flip flop 424 so that it may be set.

Actuation of the "5" key then causes current to flow from the socket 652 over the lead 117 and through a diode 686 to the node 662 and a positive pulse then flows to the "set" input 636 of the flip flop 424 and "sets" that flip flop. The output 602 of the flip flop 424 then goes positive and suppresses the alarm indication as has been explained.

After the flip flop 424 is set, the capacitor 604 charges to a positive level in roughly one tenth of a second and energizes the light emitting diode 124 with the assistance of elements 608 through 616 as has been explained.

Also, a capacitor 690 is slowly charged to a positive level through a resistor 691 from the capacitor 604 in roughly one half second. As shown, the capacitor 690 is connected to a "clear" input 625 of the first flip flop 420. Accordingly, one half second or so after all three flip flops 420, 422 and 424 have been set by striking the proper sequence of the keys they are cleared by the positive level signal that flows from the output 602 of the flip flop 424 to the input 625 of the flip flop 420. As has been explained, the diodes 646 and 648 cause the second and third flip flops 422 and 424 to be cleared when the flip flop 420 is cleared and a diode 692 rapidly discharges the capacitor 604 when the final flip flop 424 is cleared.

In summary, when the proper sequence of keys is struck, a positive pulse of one half second duration flows from the output 602 of the flip flop 424 and resets the multivibrator 432. Simultaneously, a slightly delayed pulse from this same source flows through resistor 606 and clears the alarm control flip flop 426 if it is set. Accordingly, any alarm is terminated, and any delayed alarm is suppressed.

The alarm circuit 320 is of conventional design and includes a control transistor 702 referred to above. When the output of the alarm control flip flop 426 goes low at node 480 as a result of the opening of the door 102, a base 703 of transistor 702 is clamped low (to ground) through resistor 704 to turn on transistor 702. Then when transistor 702 conducts, it connects resistors 705, 706 and 708 at +9 volts and thereby energizes the alarm circuit 320. Immediately, transistors 710, 712 and 714 interconnected by capacitors 716 and 718 and resistor 720 commence functioning as a free running multivibrator, since the two transistors 710 and 712 are connected as common emitter inverting amplifiers while the transistor 714 is simply a non-inverting emitter follower. Accordingly, the two inversions cancel out and the closed loop has a high positive net gain. The frequency at which this multivibrator oscillates is determined by the values of components 716, 718 and 720 together with the resistance of resistors 722 and 724 and the potential of a node 726 to which the resistors 722 and 724 are attached. In this respect, a saw tooth potential is developed at the node 726 and accordingly the frequency of the multivibrator varies in a saw tooth manner, rising from low to high in about one third of a second, and then quickly jumping back down to a low frequency again repeatedly. The saw tooth potential at the node 726 is developed by current flow through resistor 706 which charges a capacitor 730 until the potential of the node 726 rises above the potential of a reference node 736, the potential of which is determined by resistors 705 and 737. A transistor 738 then becomes conductive, and it in turn renders a transistor 739 conductive. The transistor 739 then clamps the transistor 738 in its conductive state while the transistor 738 discharges the capacitor 730 through the emitter base junction of the transistor 739 and through a resistor 740. In essence, the elements 705, 706, 730, 737, 738, 739 and 740 form a relaxation type saw tooth oscillator similar to a unijunction relaxation oscillator that varies the frequency of the alarm tone and the output of the transistor 714 is developed across a loudspeaker 750 referred to above.

The bird chirp circuit 330 comprises a pair of variable frequency oscillators 752 and 754. The oscillator 752 comprises a pair of integrated circuit gates 756 and 758 connected in series, with an output 760 of the gate 756 connected directly to an input 762 of the gate 758. A series circuit comprising a capacitor 764 and a resistor 766 connects an output 768 of the gate 758 to the input 762 of the same gate. An input 770 of the gate 756 is connected by a resistor 772 to a node 773 common to the capacitor 764 and the resistor 766. A triangle wave generator is thus formed that cyclically charges and discharges the capacitor 764. Each time the charge is increased or decreased sufficiently by current flow through the resistor 766, the potential at input 770 causes the outputs 760 and 768 to reverse their potentials so that the capacitor 764 is charged and discharged in the opposite direction. A square wave form appears at the output 760 and is applied to the speaker 750 by an amplifying transistor 774 through an electrolytic capacitor 775.

To vary the frequency of the oscillations, a metal-oxide semiconductor field-effect transistor 776 is connected in parallel with the resistor 766. By varying the potential applied to a gate 778 of this transistor 776, one may vary the charge/discharge rate of the capacitor 764; and hence the oscillation frequency of the variable frequency oscillator 752.

The other oscillator 754 is identical to the first but oscillates at a much slower speed. The other oscillator 754 also has two series connected NOR gates 779 and 780 with an input of the gate 779 coupled by a conductor 781 through the switch 120 to the output of the gate 472. Additionally, a series circuit comprising a diode 782 and a resistor 783 is connected across a resistor 784 that corresponds to the resistor 766 in the oscillator 752 to charge a capacitor 786 far faster than that capacitor is discharged producing a semi-saw tooth or lopsided triangular wave form. The square wave output of the oscillator 754 at an output 788 thereof periodically turns off the oscillator 752, and a lopsided triangle wave form developed at a node 790 is applied to the gate of the field effect transistor 766 to produce an intermittent chirping effect out of the speaker 750. And finally, gate 791 of a field-effect transistor 792 is driven by a wave derived from the output 470 of the multivibrator 432 via conductor 795. The field-effect transistor 792 varies the frequency of the oscillator 754 and thereby varies the spacing and duration of the "chirps". When the output 470 goes high, a saw tooth is developed by a resistor 796 and capacitor 798 coupled to conductor 795 and is applied to the gate 792 through a resistor 799 to give a realistic variation in the spacing of the chirps.

A manually actuated doorbell 800 is also provided for enabling the bird chirp circuit 330 by pulling down the potential on conductor 781 leading to an input of gate 799 through a diode 802.

By way of example, and not by way of limitation, the following resistance and capacitance values are used in a preferred embodiment of the intruder alarm device 100 of the present invention.

| RESISTORS (m = million ohms; k = thousand ohms; o = ohms) | |
|---|---|
| 436 | 12m |
| 464 | 10m |

-continued

RESISTORS (m = million ohms; k = thousand ohms; o = ohms)

| | |
|---|---|
| 494 | 10m |
| 606 | 1m |
| 610 | 1k |
| 638 | 680o |
| 642 | 10k |
| 663,664,665 | 1m |
| 670,672,674 | 1m |
| 680 | 3.3m |
| 682 | 1m |
| 691 | 4.7m |
| 704 | 10k |
| 705 | 6.8k |
| 706 | 2.2k |
| 708 | 1k |
| 713 | 100k |
| 720 | 1k |
| 722 | 6.8k |
| 724 | 20k |
| 737 | 11k |
| 740 | 100o |
| 766 | 7.5k |
| 771 | 3.3k |
| 772 | 8.6k |
| 782 | 2m |
| 784 | 10m |
| 796 | 15m |
| 799 | 100k |
| 805 | 10m |
| 809 | 47o |
| 811 | 1m |
| 813 | 100k |
| 815 | 1m |
| 817 | 10k |
| 819 | 750o |
| 821 (ten) | 2.2k |
| 823 | 100k |

CAPACITORS (m = microfarad; v = volts)

| | |
|---|---|
| 434 | 0.47m |
| 462 | 0.01m |
| 484 | 0.02m |
| 586 | 0.1m |
| 604 | 0.1m |
| 644 | 0.01m |
| 666 | 0.01m |
| 667 | 0.01m |
| 668 | 0.01m |
| 676 | 0.1m |
| 683 | 0.1m |
| 716 | 0.05m |
| 730 | 100m, 10v |
| 764 | 0.05m |
| 798 | 0.47m |
| 833 | 330m, 10v |
| 775 | 1m, 10v |
| 837 | 0.1m |
| 839 | 0.1m |

The Zener diode 612 has a breakdown voltage of 6.4 volts. All other circuit components are conventional.

While the preferred embodiment of the intruder alarm device 100 of the present invention has been described in complete detail, it is to be understood that numerous modifications and changes will occur to those skilled in the art without departing from the teachings of the invention. Accordingly, the scope of the invention is only to be limited as necessitated by the accompanying claims.

We Claim:

1. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means.

2. The device according to claim 1 wherein said signal generating means include a door motion sensing logic gate that normally has a given logic output which changes, for a short period of time, to a different logic output when the opening of the door is sensed.

3. The device according to claim 2 wherein said signal generating means include a reed switch which is normally closed and which is coupled between system ground and a normally high input to said sensing logic gate, and a magnet mounted to the door and door frame assembly adjacent the location of said reed switch for causing said reed switch to be normally closed whereby, upon opening of the door, there is relative movement between the position of said reed switch and the position of said magnet such that said reed switch is caused to open.

4. The device according to claim 3 wherein said signal generating means includes a series connected resistor-capacitor circuit connected between a positive voltage source and system ground with the junction between said resistor and said capacitor connected to one side of said reed switch and the other side of said capacitor being connected to system ground, said junction also being connected to said normally high input to said sensing logic gate.

5. The device according to claim 4 wherein said sensing logic gate includes a monostable multivibrator, one input of said monostable multivibrator being said normally high input to said sensing logic gate which is connected to said junction between said resistor and said capacitor and said monostable multivibrator having an output thereof coupled to another input of said monostable multivibrator and to said control circuit means.

6. The device according to claim 5 wherein said control circuit means comprise a mechanical switch having an INSTANT ALARM position and an OFF position and wherein said output of said monostable multivibrator is coupled to one contact of said INSTANT ALARM position of said mechanical switch and wherein said control circuit means further include a bistable multivibrator having an input connected to another contact of said INSTANT ALARM position and an output which is coupled to said audio alarm circuit means.

7. The device according to claim 6 wherein said mechanical switch includes a "DELAY ALARM" position and said signal generating means include a time delay circuit having an input coupled to the output of said monostable multivibrator and an output coupled to one contact of the "DELAY ALARM" position, the other contact of which is connected to said bistable multivibrator of said control circuit means.

8. The device according to claim 7 wherein said mechanical switch includes a "BIRD" position and wherein said device further includes a bird chirp circuit for announcing a visitor by producing a bird chirping sound when the visitor opens the door, said sensing logic including an inverting amplifier coupled between the output of said monostable multivibrator and said time delay circuit, the output of said inverting amplifier being connected to one contact of the "BIRD" position of the mechanical switch, the other contact of which is connected to one input of said bird chirp circuit and said output of said monostable multivibrator being coupled directly to another input of said bird chirp circuit.

9. The device according to claim 8 wherein said bird chirp circuit comprises first and second series connected variable frequency oscillators and a loudspeaker coupled to an output of said second oscillator.

10. The device according to claim 9 wherein said second variable frequency oscillator includes first and second series connected NOR gates with a first resistor and a capacitor coupled in series between an output of said second NOR gate and an input of said second NOR gate, one input of said first NOR gate being coupled to an output of said first variable frequency oscillator and another input of said first NOR gate being coupled by a second resistor to a node between said first resistor and said capacitor, wherein a variable resistance controlled by said first oscillator is connected across and in parallel with said first resistor, and wherein the junction between said first and second NOR gates is coupled to a base of a transistor series connected with a coil of said loudspeaker.

11. The device according to claim 10 wherein said variable resistance in said second oscillator circuit is a field effect transistor.

12. The device according to claim 10 wherein said first oscillator circuit includes first and second series connected NOR gates, and input of said first NOR gate being coupled to a contact of said "BIRD" position of said mechanical switch, a first resistor and a capacitor being series coupled between an output of said second NOR gate and an input of said second NOR gate, the junction between said capacitor and said first resistor being coupled (a) through a second resistor to the input of said first NOR gate and (b) to said variable resistance in said second oscillator circuit.

13. The device according to claim 12 wherein said first oscillator circuit includes a variable resistance which is coupled between an output of said first NOR gate and said junction between said capacitor and first resistor.

14. The device according to claim 13 wherein said variable resistance in said first oscillator circuit is a field effect transistor connected across said first resistor in parallel therewith and wherein said output of said monostable multivibrator of said signal generating means is coupled to a gate of said field effect transistor for varying the frequency of said first variable oscillator circuit at a much slower speed than the variation of the oscillation of the frequency of said second oscillator circuit.

15. The device according to claim 1 wherein said control circuit means include a double pole four throw mechanical switch having an OFF position, an INSTANT ALARM position, a DELAY ALARM position and a VISITOR ANNOUNCE position, and a control bistable multivibrator having a "set" input coupled to said INSTANT ALARM and DELAY ALARM positions and a "clear" input coupled to an output of said alarm inhibiting circuit means, and wherein said device includes a visitor announce sound producing circuit for announcing when a visitor opens the door, said visitor announce sound producing circuit being coupled through said VISITOR ANNOUNCE position of said mechanical switch to said signal generating means.

16. The device according to claim 1 wherein said first means for presenting a code to said alarm inhibiting circuit means comprises a keyboard having a plurality of key operated pushbutton switches, a first side of each of said switches being coupled to a logic level and a second side of each of said switches being coupled to a clear input of said third means for comparing a presented code with a stored code, and wherein said second means for storing a predetermined code comprises one or more leads each connected at one end to an input to said comparing means at the other end to one of said second sides of one of said key operated pushbutton switches and to a clear inhibit gate coupled between said one or more leads and said clear input of said comparing means.

17. The device according to claim 16 wherein said one or more leads comprises three leads.

18. The device according to claim 1 including visitor announce sound producing means to announce when a visitor opens the door, said visitor announce sound producing means being coupled through said control circuit means to said signal generating means.

19. The device according to claim 1 including a time delay circuit coupled between said signal generating means and said control circuit means for delaying the actuation of said control circuit means to activate said audio alarm circuit means.

20. The device according to claim 1 wherein said first means for storing a predetermined code includes one or more leads fixably connected to said third comparing means and releasably connected to said second means for presenting a code.

21. The device according to claim 20 wherein said one or more leads includes three leads.

22. The device according to claim 1 wherein said second means for presenting a code includes a keyboard having a plurality of keys and a key operated pushbutton switch associated with each key.

23. The device according to claim 1 wherein said second means for presenting a code includes a keyboard having a plurality of keys and a key operated pushbutton switch associated with each key, said third comparing means includes keyboard decoding logic circuitry and said means for storing a predetermined code includes one or more leads fixedly connected to said keyboard decoding logic circuitry and releasably connected to a selected one or more of said key operated pushbutton switches.

24. The device according to claim 23 wherein said one or more leads comprises three leads.

25. The device according to claim 1 wherein said control circuit means includes a latching circuit.

26. The device according to claim 25 wherein said control circuit means includes a mechanical switch connected between said signal generating means and said latching circuit.

27. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said control circuit means including a bistable multivibrator having an input coupled to said alarm inhibiting circuit means, another input coupled to said signal generating means and an output coupled to said audio alarm circuit means.

28. The device according to claim 27 wherein said control circuit means further include a mechanical switch coupling said signal generating means to said bistable multivibrator, said mechanical switch having an OFF position wherein the switch is open and an alarm state wherein the switch is closed.

29. The device according to claim 28 wherein said alarm state of said mechanical switch includes an INSTANT ALARM position wherein the output of said signal generating means is directly coupled to said bistable multivibrator, and a DELAY ALARM position wherein the output of said signal generating means is coupled through a time delay circuit to said bistable multivibrator.

30. The device according to claim 28 including a visitor announce sound producing circuit means and wherein said mechanical switch has a visitor announce state for coupling the output of said signal generating means to said visitor annnounce sound producing circuit means.

31. The device according to claim 30 wherein said visitor announce state is a "BIRD" position of said mechanical switch and wherein said visitor announce sound producing circuit means include a bird chirp circuit for announcing a visitor by producing a bird chirping sound when the visitor opens the door.

32. The device according to claim 31 wherein said bird chirp circuit comprises first and second series connected variable frequency oscillators and a loudspeaker coupled to an output of said second oscillator.

33. The device according to claim 32 wherein said second variable frequency oscillator includes first and second series connected NOR gates with a first resistor and a capacitor coupled in series between an output of said second NOR gate and an input of said second NOR gate, one input of said first NOR gate being coupled to an output of said first variable frequency oscillator and another input of said first NOR gate being coupled by a second resistor to a node between said first resistor and said capacitor, wherein a variable resistance controlled by said first oscillator is connected across and in parallel with said first resistor, and wherein the junction between said first and second NOR gates is coupled to a base of a transistor series connected with a coil of said loudspeaker.

34. The device according to claim 33 wherein said variable resistance in said second oscillator circuit is a field effect transistor.

35. The device according to claim 33 wherein said first oscillator circuit includes first and second series connected NOR gates, an input of said first NOR gate being coupled to a contact of said "BIRD" position of said mechanical switch, a first resistor and a capacitor being series coupled between an output of said second NOR gate and an input of said second NOR gate, the junction between said capacitor and said first resistor being coupled (a) through a second resistor to the input of said first NOR gate and (b) to said variable resistance in said second oscillator circuit.

36. The device according to claim 35 wherein said first oscillator circuit includes a variable resistance which is coupled between an output of said first NOR gate and said junction between said capacitor and first resistor.

37. The device according to claim 36 wherein said variable resistance in said first oscillator circuit is a field effect transistor connected across said first resistor in parallel therewith and wherein said output of said monostable multivibrator of said signal generating means is coupled to a gate of said field effect transistor for varying the frequency of said first variable oscillator circuit at a much slower speed than the variation of the oscillation of the frequency of said second oscillator circuit.

38. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said third means for comparing the presented code with the stored code including first, second and third bistable multivibrators, a NOR gate having three inputs and an output coupled to a clear input of said first bistable multivibrator, said second means for presenting a code including a keyboard having a plurality of key switches each of which has a first contact on one side of the switch connected to a voltage source and a second contact on the other side thereof connected to system ground through a resistance and to a clear input of said first bistable multivibrator, said first means for storing a code including first, second and third control leads each adapted to be releasably connected to one of said second contacts of one of said key switches and being connected to one of said inputs to said NOR gate and to a set input of a respective one of said multivibrators, an output of said first multivibrator being coupled to a clear input of said second multivibrator, an output of said second multivibrator being coupled to a clear input of said third multivibrator and an output of said third multivibrator being coupled to said control circuit means, said leads being releasably connected to selected ones of said key switches such that sequential depression of those keys connected to said first, second and third leads will operate said multivibrators to generate an alarm inhibit signal at said output of said third multivibrator.

39. The device according to claim 38 including a light emitting diode and a control circuit for said light emitting diode having an input coupled to said output of said third multivibrator and being operable to cause light to be emitted by said diode when an alarm inhibit signal appears at said output of said third multivibrator.

40. The device according to claim 38 wherein said third means for comparing the presented code with the stored code include a time delay clear circuit coupled between said output of said third multivibrator and said clear input of said first multivibrator.

41. The device according to claim 38 wherein said first multivibrator is coupled through a time delay circuit to said second multivibrator and said second multivibrator is coupled through a time delay circuit to said third multivibrator so that said keys must be operate slowly in order to generate an alarm inhibit signal.

42. The device according to claim 38 wherein said output of said third multivibrator is coupled through a time delay circuit to a control multivibrator of said control circuit means.

43. The device according to claim 38 wherein said output of said third multivibrator is coupled through a time delay circuit to said clear input of said first multivibrator for resetting same after a predetermined time.

44. A door opening sensing and alarm producing device for mounting to a door and door frame assembly and including audio alarm circuit means for generating an audio alarm, control circuit means coupled to said circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said audio alarm circuit means including a control transistor having its base coupled to said control circuit means and being operable when turned on by an alarm signal from said control circuit means to energize said audio alarm circuit means, said audio alarm circuit means including a loudspeaker with an energizing coil, a free-running multivibrator circuit having an output coupled to said coil, and a relaxation type saw tooth oscillator having an output coupled into said free-running multivibrator circuit for varying the frequency of the alarm tone produced by said free-running oscillator.

45. The device according to claim 44 wherein said free-running multivibrator circuit includes first and second transistors coupled such that the base of the first transistor is coupled through a series connected capacitor and resistor to the collector of said second transistor, the collector of said first transistor being coupled by another capacitor to the base of said second transistor, the emitter of said first transistor being coupled through a control resistor to system ground, and the emitter of said transistor being coupled through an emitter follower amplifier to said coil of said loudspeaker.

46. The device according to claim 45 wherein said relaxation type saw tooth oscillator includes first and second transistors coupled such that the base of said first transistor is connected to the collector of said second transistor and through a base resistor to said control resistor, the output of said second transistor at said emitter thereof being connected to said emitter of said first transistor in said free-running multivibrator which is also connected through said control resistor to system ground, and the emitter of said first transistor in said relaxation type saw tooth oscillator being coupled through a control capacitor to system ground through a charging resistor to said control transistor and through first and second base resistors to said respective bases of said first and second transistors in said free-running multivibrator, said control capacitor controlling the frequency of oscillation of the relaxation type saw tooth oscillator.

47. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third meansfor comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said control circuit means including a double pole four throw mechanical switch having an OFF position, an INSTANT ALARM position, a DELAY ALARM position and a BIRD position, and a control bistable multivibrator having a set input coupled to said INSTANT ALARM and DELAY ALARM positions and a clear input coupled to an output of said alarm inhibiting circuit means, and said device further including a bird chirp circuit for announcing when a visitor opens the door, said bird chirp circuit being coupled through said BIRD position of said mechanical switch to said signal generating means.

48. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said means for presenting a code to said alarm inhibiting circuit means including a keyboard having a plurality of key operated pushbutton switches for keying a code into said alarm inhibiting circuit means, said means for comparing said presented code with said stored code including keyboard docoding logic comprising three series coupled memory devices, a control gate coupled between said means for storing a predetermined code and a "clear" input of said first memory device, the output of said third memory device being coupled to said control circuit means, and said means for storing a predetermined code including three leads all connected to the input of said control gate and each connected to a "set" input of a respective one of said memory devices, and each lead being connectable to one side of one of said pushbutton switches of said keyboard which also is connected to said "clear" input of said first memory device such that actuation of a "wrong" key operated pushbutton switch will couple a logic voltage to said "clear" input of said first memory device and actuation of a right key operated bushbutton switch will operate said control gate to prevent said logic voltage from being applied to said "clear" input while at the same time a logic voltage is being applied to said "set" input of said first memory device, followed by similar application of a logic voltage to said "set" input of said second and third memory devices upon sequential actuation of the second "right" key operated pushbutton switch and the third "right" key operated pushbutton switch to produce an alarm inhibit signal at said output of said third memory device.

49. The device according to claim 48 wherein said keyboard decoding logic includes a time delay resistor-capacitor circuit coupled between the output of said first memory device and the input of said second memory device and a time delay resistor-capacitor circuit coupled between the output of said second memory device and the input to the third memory device so that said keys corresponding to the predetermined stored code must be operated at a predetermined rate and cannot be operated too rapidly to produce said alarm inhibit signal.

50. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means for operating said audio alarm circuit means, said device further including bird chirp circuit means for producing a bird chirping sound to announce a visitor when a visitor opens the door, said bird chirp circuit being coupled to said control circuit means and to said signal generating means.

51. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said signal generating means including door motion sensing logic that has a given logic output which changes, for a short period of time, to a different logic output when the opening of the door is sensed, two parallel connected reed switches mounted within and on either side of a housing for said device in which the various circuit means are also mounted, each reed switch being normally closed and being coupled between system ground and a normally high input to said sensing logic, and a magnet mounted to the door and door frame assembly adjacent the location of one of said reed switches for causing said one of said reed switches to be normally closed whereby, upon opening of the door, there is relative movement between the position of said one of said reed switches and the position of said magnet such that said one of said reed switches is caused to open to apply a signal to said sensing logic.

52. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means, and programmable alarm inhibiting circuit means coupled to said control circuit means and including first means for storing a predetermined code, second means for presenting a code to said alarm inhibiting circuit means, and third means for comparing the presented code with the stored predetermined code and, when the code presented is presented in a proper time sequence and corresponds with the predetermined code, for producing an alarm inhibit signal which is supplied to said control circuit means for inhibiting or stopping said control circuit means from operating said audio alarm circuit means, said control circuit means including a latching circuit having an output coupled to said audio alarm circuit means and a mechanical switch coupled to an input of said latching circuit, said mechanical switch having an instant alarm position for connecting said signal generating means directly to said latching circuit and a delay alarm position for connecting said signal generating means through a time delay circuit to said latching circuit.

53. The device according to claim 52 including visitor announce sound producing means coupled to said mechanical switch and when activated, producing a sound to announce when a visitor opens the door, said mechanical switch having a visitor announce position where said signal generating means is coupled through said visitor announce and sound producing means.

54. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means and programmable alarm inhibiting circuit means coupled to said control circuit means for supplying, upon proper actuation of said alarm inhibiting circuit means, for an alarm inhibit signal to said control circuit means to inhibit or stop said control circuit means from operating said alarm circuit means, said control circuit means including a latching circuit having an output coupled to said audio alarm circuit means and a mechanical switch having one said thereof coupled to an input to said latching circuit and having the other side thereof directly or indirectly coupled to said signal generating means, said mechanical switch having an instant alarm position for directly coupling said signal generating means to said latching circuit and a delay alarm position for coupling said signal generating means through a time delay circuit to said latching circuit.

55. The device according to claim 54 including visitor announce sound producing means coupled to said one side of said mechanical switch and said mechanical switch having a visitor announce position for coupling said signal generating means to said visitor announce sound producing means.

56. The device according to claim 55 wherein said mechanical switch includes an off position wherein the delay alarm contacts, the instant alarm contacts and the visitor announce contacts of the mechanical switch are open circuited, said mechanical switch being a four pole double throw mechanical switch.

57. A door opening sensing and alarm producing device for mounting to a door and door frame assembly and including audio alarm circuit means for generating an audio alarm, control circuit means coupled to said alarm circuit means for controlling operation of said alarm circuit means, signal generating means for sensing when the door has been opened and for generating an alarm signal, said signal generating means being coupled to said control circuit means for supplying an alarm signal thereto for causing said control circuit means to operate said alarm circuit means and programmable alarm inhibiting circuit means coupled to said control circuit means for supplying, upon proper actuation of said alarm inhibiting circuit means, an alarm inhibit signal to said control circuit means to inhibit or stop said control circuit means from operating said alarm circuit means, said signal generating means including a time delay circuit, said device further including visitor announce sound producing means and said control circuit means including mechanical switch means for connecting said signal generating means (a) directly to said control circuit means, (b) through said time delay circuit to said control circuit means, or (c) to said visitor announce sound producing means.

58. The device according to claim 57 wherein said control circuit means includes latching circuit means coupled between said mechanical switch means and said audio alarm circuit means.

* * * * *

UNITED STATES PATENT OFFICE
CERTIFICATE OF CORRECTION

PATENT NO. : 4,258,358

DATED : March 24, 1981

INVENTOR(S) : Thomas K.P. Lee and Hau C. Lam

It is certified that error appears in the above-identified patent and that said Letters Patent are hereby corrected as shown below:

Column 3, lines 3 & 4, delete "being coupled to said control circuit means for supplying an alarm signal thereto"
Column 3, lines 9 & 10, delete "an alarm inhibit signal to said control circuit means"
Column 4, line 38, change "emitter" to --emitting--.
Column 5, line 67, after "return" insert --to--.
Column 7, line 7, after "output" insert --602--.
Column 7, line 33, (second occurrence) change "flop flop" to --flip flop--.

Column 9, line 36, change "at" to --to--.
Column 10, line 44, change "766" to --776--.
Column 12, lines 46 & 47, change "sensing logic gate" to --signal generating means--.
Column 13, lines 11 & 12, change "sensing logic" to --signal generating means--.
Column 13, line 40, delete "circuit".
Column 13, line 43, delete "circuit".
Column 13, line 52, delete "circuit".
Column 13, line 59, delete "circuit".
Column 13, line 65, delete "circuit".
Column 13, line 67, delete "circuit".
Column 16, line 10, delete "circuit".
Column 16, line 22, delete "circuit".
Column 16, line 24, delete "circuit".
Column 16, line 29, delete "circuit".
Column 16, lines 31 & 32, delete "said monostable multivibrator of".
Column 16, line 35, delete "circuit".
Column 16, line 37, delete "circuit".
Column 17, line 1, change "a clear" to --said clear--.

Column 17, line 34, change "operate" to --operated--.
Column 17, line 47, after "said" insert --alarm--.

UNITED STATES PATENT OFFICE
CERTIFICATE OF CORRECTION

PATENT NO. : 4,258,358

DATED : March 24, 1981

INVENTOR(S) : Thomas K.P. Lee and Hau C. Lam

It is certified that error appears in the above-identified patent and that said Letters Patent are hereby corrected as shown below:

Continued

Column 18, line 8, change "oscillator" to --multivibrator circuit--.
Column 18, line 18, before "transistor" insert --second--.
Column 18, line 31, after "ground" insert --,--.
Column 22, line 4, change "one said" to --one side--.

Signed and Sealed this

*Twenty-first* Day of *December 1982*

[SEAL]

*Attest:*

GERALD J. MOSSINGHOFF

*Attesting Officer* *Commissioner of Patents and Trademarks*